US009421588B2

(12) United States Patent
Fuchigami et al.

(10) Patent No.: US 9,421,588 B2
(45) Date of Patent: Aug. 23, 2016

(54) ANTI-CLEANSER DISPERSING ELEMENT, OBJECT HOLDER, AND DRY WASHING DEVICE

(71) Applicants: Akihiro Fuchigami, Yamato (JP); Yoichi Okamoto, Atsugi (JP); Yuusuke Taneda, Zama (JP); Kohji Tsukahara, Sagamihara (JP); Shozo Murata, Atsugi (JP)

(72) Inventors: Akihiro Fuchigami, Yamato (JP); Yoichi Okamoto, Atsugi (JP); Yuusuke Taneda, Zama (JP); Kohji Tsukahara, Sagamihara (JP); Shozo Murata, Atsugi (JP)

(73) Assignee: RICOH COMPANY, LTD., Tokyo (JP)

( * ) Notice: Subject to any disclaimer, the term of this patent is extended or adjusted under 35 U.S.C. 154(b) by 793 days.

(21) Appl. No.: 13/660,315

(22) Filed: Oct. 25, 2012

(65) Prior Publication Data

US 2013/0104945 A1 May 2, 2013

(30) Foreign Application Priority Data

Oct. 26, 2011 (JP) ..... 2011-235272
Jun. 25, 2012 (JP) ..... 2012-142248

(51) Int. Cl.
*B08B 5/00* (2006.01)
*B08B 7/02* (2006.01)

(52) U.S. Cl.
CPC .... *B08B 5/00* (2013.01); *B08B 7/02* (2013.01)

(58) Field of Classification Search
CPC ..... B08B 5/00; B08B 7/02
USPC ..... 134/198
See application file for complete search history.

(56) References Cited

U.S. PATENT DOCUMENTS

| | | | | |
|---|---|---|---|---|
| 6,986,308 | B1 * | 1/2006 | King et al. | 108/43 |
| 7,743,776 | B2 | 6/2010 | Okamoto et al. | |
| 7,758,700 | B2 | 7/2010 | Fuchigami et al. | |
| 7,854,648 | B2 | 12/2010 | Satoh et al. | |
| 2007/0107752 | A1 | 5/2007 | Fuchigami et al. | |
| 2007/0283980 | A1 * | 12/2007 | Okamoto et al. | 134/7 |
| 2008/0052953 | A1 | 3/2008 | Okamoto et al. | |
| 2009/0314312 | A1 | 12/2009 | Fuchigami et al. | |

(Continued)

FOREIGN PATENT DOCUMENTS

| | | | |
|---|---|---|---|
| CN | 101959621 | A | 1/2011 |
| JP | 2000-174102 | A | 6/2000 |
| JP | 2007-029945 | A | 2/2007 |

(Continued)

OTHER PUBLICATIONS

Combined Chinese Office Action and Search Report issued May 4, 2014 in Patent Application No. 201210520737.7 (with English language translation).

(Continued)

*Primary Examiner* — Michael Barr
*Assistant Examiner* — Levon J Shahinian
(74) *Attorney, Agent, or Firm* — Oblon, McClelland, Maier & Neustadt, L.L.P.

(57) ABSTRACT

Provided is an anti-cleanser dispersing element for use in a dry washing device which disperses cleanser by an air stream to allow the cleanser to collide with an object for washing. The anti-cleanser dispersing element is disposed on a side of a holder of the object opposite to a side with which the cleanser collides. The anti-cleanser dispersing element is configured to be deformed by its own weight or pressure in accordance with an outer shape of the object, to tightly attach to the object with no gap and prevent the cleanser from moving to the opposite side of the holder.

11 Claims, 14 Drawing Sheets

(56) References Cited

U.S. PATENT DOCUMENTS

| | | | |
|---|---|---|---|
| 2010/0307535 | A1 | 12/2010 | Fuchigami et al. |
| 2011/0067731 | A1 | 3/2011 | Satoh et al. |

FOREIGN PATENT DOCUMENTS

| | | | |
|---|---|---|---|
| JP | 2008-237985 | A | 10/2008 |
| JP | 2009-226394 | | 10/2009 |
| JP | 2009-275397 | A | 11/2009 |
| JP | 2010-022898 | A | 2/2010 |
| JP | 2010-069368 | | 4/2010 |
| JP | 2010-167419 | | 8/2010 |
| JP | 2012-050973 | | 3/2012 |
| WO | WO2012/018100 | A1 | 2/2012 |

OTHER PUBLICATIONS

Japanese Office Action issued Feb. 23, 2016 in JP Patent Application No. 2012-142248.

* cited by examiner

ANTI-CLEANSER DISPERSING ELEMENT, OBJECT HOLDER, AND DRY WASHING DEVICE

CROSS REFERENCE TO RELATED APPLICATION

The present application is based on and claims priority from Japanese Patent Application No. 2011-235272, filed on Oct. 26, 2011 and No. 2012-142248, filed on Jun. 25, 2012, the disclosure of which is hereby incorporated by reference in its entirety.

BACKGROUND OF THE INVENTION

1. Field of the Invention

The present invention relates to a dry washing device to wash an object by dispersing a cleanser to collide with the object, an object holder used in the dry washing device, and an anti-cleanser dispersing element set in the object holder.

2. Description of the Related Art

To manufacture print circuit boards, in soldering process with a flow soldering tank, a masking jig is often used for masking an area of a board other than that to be soldered. Such a masking jig is a plate with openings called dip palette or flow palette. It is necessary to periodically wash the surfaces of the jig to remove fluxes accumulated thereon in a repeated use, which decrease masking accuracy.

To remove fluxes or adhesives from an object such as jig, the top and bottom surfaces of the object is washed with an injected solvent in a tank, rinsed with water to remove the solvent, and dried with warm air. However, washing the object with a solvent by a washing machine not only uses a large amount of solvent but also consumes a large amount of energy for the disposal of liquid waste containing the fluxes and the drying process. This increases manufacturing costs and brings a large load on the environment.

To deal with the problem, a dry washing machine is available which blasts off a solid, light-weight, dispersive cleanser in a washing tank at a high speed, allows the cleanser to continuously contact or collide with an object, and separates attached matters on the object without using a solvent. This dry washing machine can effectively clean the object with a small amount of solvent by circulating the cleanser in the washing tank to repeatedly collide with the object. Especially, by use of a cleanser of a thin flexible plate-like shape, it can exert cleaning performance with a less amount of cleanser as much as that of ultrasonic cleaning.

For example, Japanese Patent No. 4531841 discloses a washing device having a downsized washing tank which can efficiently wash an object with uneven surfaces with a dispersed cleanser by placing the object outside the washing tank and sliding it relative to the opening of the tank. This device can prevent the cleanser from leaking to outside the tank and properly return it to the tank area so that it can maintain the number of cleanser particles to collide with the object and exert good, stable cleaning performance.

Specifically, referring to FIG. 15, this device comprises a semi-cylindrical washing tank 6 with an opening 6*a* and an object holder 3. The holder 3 holding a flow palette 4 is set on the opening 6*a* of the tank. It also includes a pool portion 19 on the side of the opening in which the cleanser is accumulated. While the holder 3 is holding the object 4, the pool portion is moved in horizontal direction in the drawing. A cleanser 5 is a thin resin plate but is represented by circles in the drawing for better understanding.

An acceleration nozzle 11 is provided on the center of the bottom of the washing tank 6 to inject air streams to disperse the cleanser 5 and remove the fluxes from the object 4. The cleanser is absorbed into a suction duct 18 connected with a not-shown suction unit, returned to the washing tank 6 and used again. Further, the cleanser 5 which has lost motion energy and has been accumulated in the pool portion 19 is returned to the washing tank by a scraper 26 provided on the bottom surface of the object holder 3.

The object holder 3 is a plate longer than the object 4 and includes at the center a concave portion 23 in a form in conformity with the shape of the object 4. The concave portion 23 is made from an elastic material such as polyurethane rubber or foamed resin and the object 4 is pressed into the concave portion 23 and held by friction. The object holder is configured to tightly hold the object with no gap to prevent the cleanser from clogging and not to leak the air streams. This aims to prevent the cleanser accelerated by compressed air from scattering from the openings of the flow palette and maintain the cleaning performance of the washing tank.

Referring to FIG. 16, a description is made on how to set the object 4 in the opening of the washing tank. The object 4 is pressed into the concave portion 23 of the holder 3 and the holder is reversed and set in the pool portion 19 of a tank unit 2. The holder 3 is slid by a not-shown moving mechanism to move the surface of the object for washing. FIG. 16 shows a linear guide 20 and a side guide 21 of the pool portion 19.

However, the object holder of the above machine faces problems as follows:

1. Since the concave portion of the holder is formed in accordance with the shape of a specific object, it cannot hold objects of different shapes and is lack of general versatility. Different holders need to be prepared for different objects.
2. It is troublesome to reverse the object to face the washing tank after setting it in the holder. Also, it will be difficult to reverse a large object, which requires labor.
3. Holding the object by friction is not stable, and the object may be suctioned by negative pressure in the tank and come off from the holder.

For the above reasons, a frame type object holder including a cover for closing only the opening of a washing tank and pins to partially hold an object is mostly in practical use. An object is placed from above in the frame of this holder fixed in a washing machine and supported by the pins on the bottom surface of the frame. The size of the frame is designed to match with the outer shape of an object. To hold a different object of a different outer shape, one side of the frame is slid for size adjustment. For a flow palette as a cleaning object, an operator first sets a printed circuit board or a plate of the same size as that of the printed circuit board on the surface of the flow palette opposite to the one to wash, to cover the openings of the flow palette. Then, the operator places the flow palette and the plate in the frame, and fixes them with the pins. The openings of the flow palette are closed with the plate and the side faces thereof are tightly attached to the inner surfaces of the object holder with no gap from which the cleanser can be scattered. Thus, the plate functions as an anti-cleanser dispersing element.

However, this kind of holder faces the following problems:

1. It cannot deal with objects of different lateral and longitudinal sizes.
2. It cannot deal with objects of shapes other than rectangular.
3. It is troublesome to change the plate for washing different kinds of objects.

SUMMARY OF THE INVENTION

An object of the present invention is to provide an anti-cleanser dispersing element which can be easily set and prevent a cleanser from dispersing irrespective of different surface shapes of objects to wash and makes it easier to hold the object relative to a washing device.

According to one embodiment, provided is an anti-cleanser dispersing element for use in a dry washing device which disperses cleanser by an air stream to allow the cleanser to collide with an object for washing. The anti-cleanser dispersing element is disposed on a side of a holder of the object opposite to a side with which the cleanser collides. The anti-cleanser dispersing element is configured to be deformed by its own weight or pressure in accordance with an outer shape of the object, to tightly attach to the object with no gap and prevent the cleanser from moving to the opposite side of the holder.

BRIEF DESCRIPTION OF THE DRAWINGS

Features, embodiments, and advantages of the present invention will become apparent from the following detailed description with reference to the accompanying drawings.

DETAILED DESCRIPTION OF PREFERRED EMBODIMENTS

Hereinafter, embodiments of the present invention will be described in detail with reference to the accompanying drawings. Wherever possible, the same reference numbers will be used throughout the drawings to refer to the same or like parts.

First Embodiment

Figure 1:
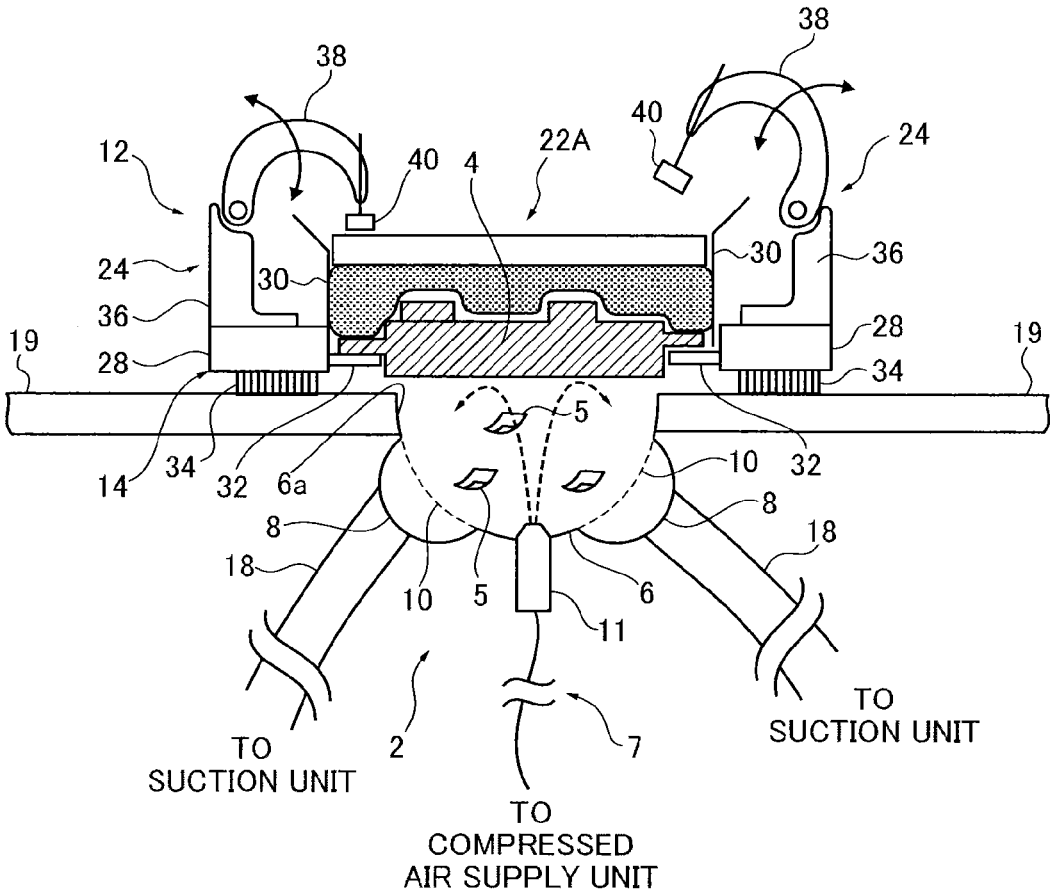
FIG. 1 is a schematic cross section of the essential part of a dry washing device according to a first embodiment of the present invention.

A first embodiment is described with reference to FIGS. 1 to 4. FIG. 1 shows the essential part of a dry washing device 1 according to the present embodiment which comprises a washing tank unit 2 and an object holder 12. The washing tank unit 2 includes a tank 6, a cleanser accelerator 7, a pool 19, a separator 10 and a void 8. The separator 10 faces a suction duct 18 and the void 8 is formed between the separator 10 and the suction duct 18 to expand to outside from the tank 6. The tank 6 is in a semi-cylindrical shape with an opening 6*a* at the top. The void 8 with a half-circular cross section extends along the length of the tank 6. The separator 10 includes a large number of small holes or slits through which gaseous matter and powder particles pass but a cleanser cannot. The separator 10 is made of a porous element such as metal net, plastic net, mesh, punching metal, or slit plate, for example, to be a smooth shape not to allow the accumulation of the cleanser. The tank 6 can be of a double structure including the separator therein.

The separator 10 is connected to the suction duct 18 via the void 8 and the duct 18 is connected to a not-shown a suction unit which is configured to suction the sufficient amount of air from the tank relative to the amount of air blown from an accelerator nozzle 11 via the duct and separator and keep the tank under a negative pressure. The cleanser accelerator 7 includes an accelerator nozzle 11 with outlets and a not-shown compressed air supply unit as a compressor. The accelerator nozzle 11 is disposed so that the outlets are aligned in a straight line along the center of the tank bottom. The accelerator nozzle 11 is connected via an air pipe with a control valve to the compressed air supply unit which supplies compressed air to the nozzle to blast off the cleanser 5.

The pool 19 is in a concave shape, has a certain length and is provided at both sides of the tank. It has, at the corner of a level surface, a linear guide 20 as a rectangular column made from a smooth material such as fluorine resin with a thickness of about 5 mm, for example. The linear guide 20 works to hold the object holder 12 and guide it to move horizontally in the drawing together with a side guide 21. The holder 12 is connected with a not-shown driver such as DC motor, air cylinder, or wire driver and moved by the driver according to a control signal from a not-shown controller along the pool in parallel to the operation of the washing tank unit. The size of the pool is equal to or larger than the moving range of the object held by the holder.

The object holder 12 comprises a frame 14 to hold the object, facing the opening 6*a* and a pressure element 24 to apply pressure to an anti-cleanser dispersing element 22A held in the frame 14. The contour of the frame 14 is larger than the size of the opening 6*a* and includes a base 28 as a rectangular frame to cover the upper part of the opening 6*a* and walls 30 standing on the four sides of the base 28. The walls 30 are rectangular frames formed by plate folding processing and include top ends folded outward to easily insert the anti-cleanser dispersing element 22A in the frame 14. Pins 32 are provided on the opposite sides of the base 28 to protrude inward and support the object 4. An anti-leakage element 34 is provided on the bottom face of the base 28 to return the cleanser accumulated in the pool 19 to the tank 6. The anti-leakage element 34 is made of a brush with dense hairs to allow airflow but prevent the leakage of the cleanser 5.

The pressure elements 24 are toggle clamps each including a support element 36 fixed to the base 28, an arc arm 38 rotatably supported by the support element 36, and an adjusting pad 40 attached to the tip end of the arm 38 via a screw shaft. The arms 38 are rotated to press the anti-cleanser dispersing element 22A and the pressed elements 24 are locked by a not-shown lever. The pressure elements 24 are disposed at four positions, facing each other (FIG. 8) to be able to press the maximum support area of the frame 14 relative to the object 4. The pressure is equalized at the four positions by adjusting the positions of the pads 40. The position of the support elements 36 relative to the base 28 can be fixed or it can be fixed with a detachable screw to change pressure positions.

Figure 2:
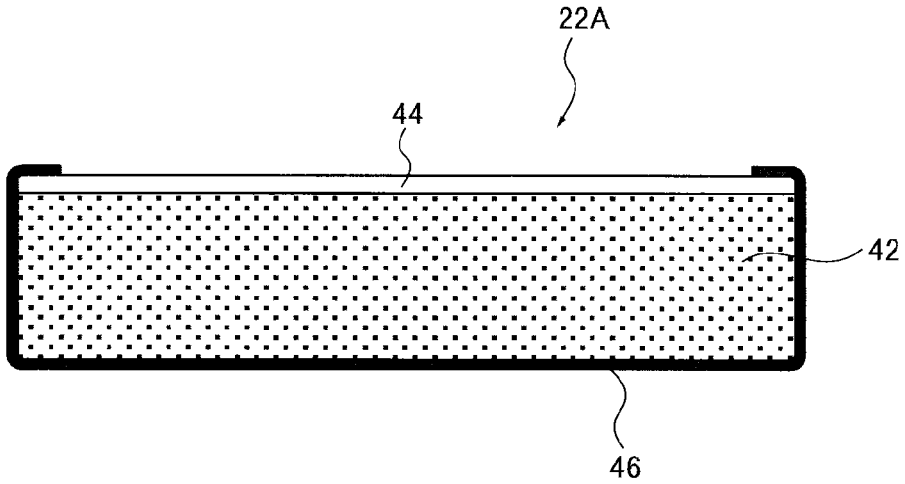
FIG. 2 is a schematic cross section of an anti-cleanser dispersing element.

In FIG. 2 the anti-cleanser dispersing element 22A is comprised of a core element 42 to deform in accordance with the outer shape of the object 4, a plastic plate 44 with rigidity disposed on the face opposite to that with which the cleanser 5 collides, and a surface layer 46 to cover at least the core element 42. The surface layer 46 is made from an anti-wear material to protect from the collision of the cleanser 5 and not to inhibit the deformability of the core element 42. In the rest of the drawings the surface layer 45 may be omitted. In the present embodiment the core element 42 is made of a low repulsive urethane sponge, and the surface layer 46 is made from a stretch material and the top end thereof is fixed to the plate 44 by adhesion. The anti-cleanser dispersing element 22A functions as an individual unit separately from the dry washing device 1. Herein, low repulsive property refers to low repulsive elasticity of 15% or less (JIS K64003) in a precise sense and a low repulsive foamed material is continuous bubbles composed of polyurethane resin, for example.

The core element 42 is inherently soft and not easily used. However, integrated with the rigid plate 44, its usability is improved. The plate 44 is also an interface to apply pressure evenly to the entire core element 42 at a small number of pressure points (four in the present embodiment).

Figure 3A:
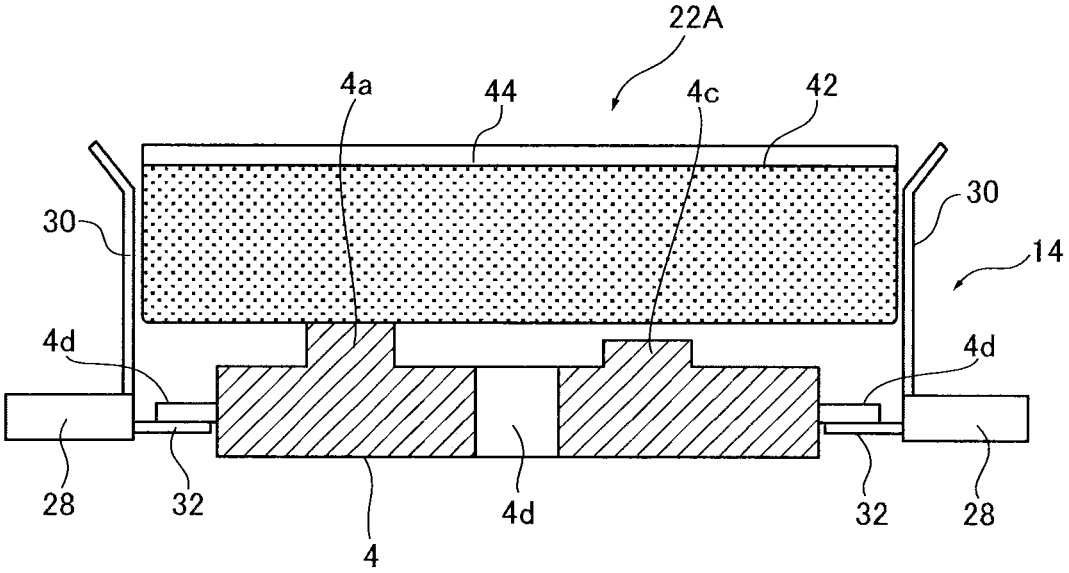
FIG. 3A shows that the anti-cleanser dispersing element is inserted in the object holder.
Figure 3B:
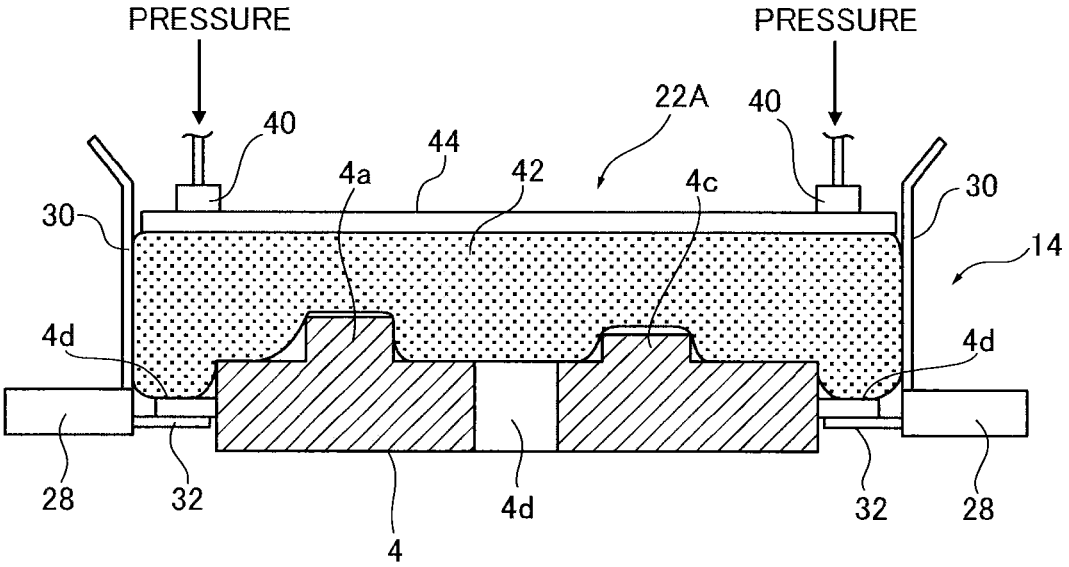
FIG. 3B shows that it is deformed with pressure.

Next, the washing operation of the dry washing device 1 according to the present embodiment is described referring to FIGS. 3A, 3B. First, the proper amount of the cleanser 5 to wash the object 4 is poured in the tank 6. The proper amount is preset through experiments. Then, as shown in FIG. 3A, the object 4 as a flow palette is inserted into the frame 14 and supported by the pins 32. The anti-cleanser dispersing element 22A is placed on the flow palette 4 in the frame 14. With a small gap between the frame 14 and the anti-cleanser dispersing element 22A, it can be easily inserted in the frame 14. The bottom face of the anti-cleanser dispersing element 22A inserted in the frame 14 is restricted by the highest protrusion 4*a* of the flow palette 4 to prevent the cleanser from being dispersed upward to outside of the frame 14. However, the cleanser 5 flows through the gap between the frame 14 and both ends of the flow palette 4 and the opening 4*b* of the flow palette and becomes accumulated on the flow palette 4. Thus, the amount of the cleanser 5 is reduced over time and its cleaning performance is degraded accordingly. In FIG. 3A the palette 4 includes strips 4*d* to be placed on the pins 32.

Figure 4:
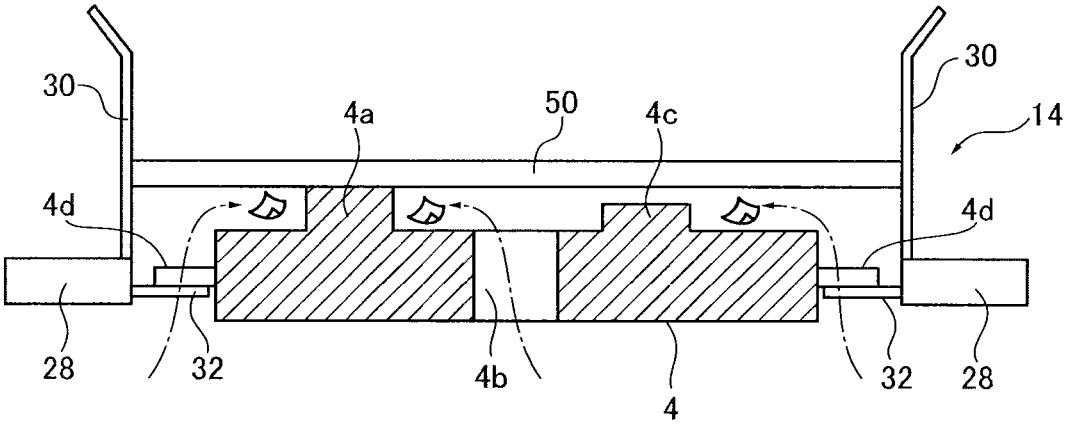
FIG. 4 shows the use of a non-deformable element as an anti-cleanser dispersing element.

The anti-cleanser dispersing element 22A is inserted in the frame 14 and pressed and locked by the pressure elements 24. The core element 42 is deformed by the pressure in accordance with the outer shape of the flow palette 4 as shown in FIG. 3B. The surface layer 46 is also deformed along with the core element 42. Therefore, the anti-cleanser dispersing element 22A can be deformed with different heights of the protrusions 4*a* and 4*c*, thereby closing the opening 4*b* and the gap between the flow palette 4 and the frame 14. FIG. 4 shows a rubber or rigid plate 50 provided to enclose the flow palette 4 in the frame 14. However, the plate 50 cannot prevent the cleanser 5 from being accumulated on the top surfaces of the flow palette 4 and strips 4*d*, and the amount of the cleanser 5 is reduced accordingly.

As shown in FIG. 3B, the anti-cleanser dispersing element 22A according to the present embodiment tightly encloses the flow palette 4 so that it can prevent the accumulation of the cleanser 5 and certainly return the one not colliding with the flow palette 4 to the tank 6. Further, the anti-cleanser dispersing element 22A is arbitrarily deformable in accordance with any shape of the object 4, which eliminates the necessity to prepare different elements for objects of different shapes. Various elements are arranged on the top surface of the flow palette to fix a print circuit board. The low repulsive sponge and stretch material are flexibly deformed to be able to tightly enclose the opening 4*b*. The object does not receive a large load from the low repulsive sponge even if it is pressed thereby. Moreover, applied with pressure, the anti-cleanser dispersing element 22A is deformed to closely attach to the inner surface of the frame 14 with no gap, preventing a decrease in blast-off speed of the cleanser 5 due to an air leakage.

When the anti-cleanser dispersing element 22A is locked with pressure, a closed space in which the cleanser is dispersed is formed between the flow palette 4 and tank 6. Then, the air is suctioned from the space by the suction unit driven by a not-shown controller. The controller drives the compressed air supply unit to supply compressed air to the accelerator nozzle 11 and generate a vertically upward air stream. By the air stream, the cleanser 5 is blasted off to collide with the flow palette 4 and efficiently remove attached flux from the surface of the flow palette 4. After the collision, the cleanser 5 drops by the air stream and gravity, and slides down near the accelerator nozzle 11 while suctioned over the separator 10. Thereby, attached powder fluxes on the flow palette are suctioned, separated by the separator 10 and collected by the suction unit through the duct 18. Further, the cleanser having dropped near the accelerator nozzle 11 is blasted off vertically upward again by the air stream from the accelerator nozzle 11. The dry washing device 1 repeats this operation to remove attached fluxes on the surface of the flow palette.

While the flow palette 4 is being cleaned with the cleanser 5, a part of the cleanser enters the gap between the pool 19 and the object holder 19. However, the anti-leakage element 34 under the object holder 12 can block the cleanser from leaking to the outside of the washing device 1, allowing the cleanser to be accumulated on the pool 19. The cleanser on the pool 19 is scraped by the anti-leakage element 34 along with the reciprocating movement of the object holder 12, returned to the tank 6, and blasted off vertically upward again by the air stream from the accelerator nozzle 11.

Thus, the anti-cleanser dispersing element 22A eliminates the gap in which the cleanser 5 is scattered upward so that the cleanser 5 can be recirculated in the tank 6 and over the pool 19 without reduction in amount. Because of this, the washing device does not decrease in cleaning performance due to a lack of the cleanser even in operation over a long time. Accordingly, it is made possible to certainly clean even large-size flow palettes by reciprocatively moving the object holder 12 relative to the tank 6.

The anti-cleanser dispersing element 22A can be made of the core element 42 alone without the surface layer 46. However, it was found by experiment that the low repulsive urethane sponge as the core element 42 is easily damaged by the collision with the cleanser 5. A large damage impairs the deformability of the core element. In the present embodiment the two different elements work for deformability and anti-wear separately, aiming for preventing early degradation of the anti-cleanser dispersing element 22A. The surface of the urethane sponge can be formed with coating having anti-wear property and no hindrance to the deformability of the urethane sponge.

The anti-wear property of the surface layer 46 of a stretch material does not continue for good and will be degraded over repeated use. A replaceable surface layer 46 is more cost-effective than the replacement of the entire element 22A.

Further, according to the present embodiment the top end of the surface layer 46 is fixed to the plate 44. It can be formed to be detachable with a loop fastener for replacement. Alternatively, it can be formed in a bag to wrap around the core element 42 and plate 44 and attached/detached by closing/opening the fastener. The present embodiment describes the use of low repulsive urethane sponge as the core element 42 by way of example. However, it can be an arbitrary element such as fluid as air or water or powder or powdery matter as long as a necessary deformability is acquired.

The cleanser 5 possesses a pencil hardness (measured under JIS K-56005-4) equal to or larger than that of attached fluxes and a folding strength of 45 or less (measured under JIS P8115). It cracks and creates new edges when continuously given an impact to thereby maintain flux removing performance. In the present embodiment the cleanser 5 is a thin rectangular strip in size of 1 to 100 $mm^2$ and thickness of 0.05 to 0.2 mm, however, they should not be limited thereto The size, thickness, and material of the cleanser can be arbitrarily determined depending on the object.

The thin-strip cleanser is very small in mass relative to air resistance so that it is easily accelerated and dispersed by an air stream flowing in a direction of a large project area. Also, air resistance is small in a direction of a small project area so that the cleanser floating in this direction can maintain fast motion over a long distance. This increases the energy of the cleanser and the force acting on the object, resulting in effectively removing attached matter on the surface of the object and enhancing the cleaning efficiency since repeated circulation of the cleanser increases the frequency at which it contacts the object.

Second Embodiment

Figure 5A:
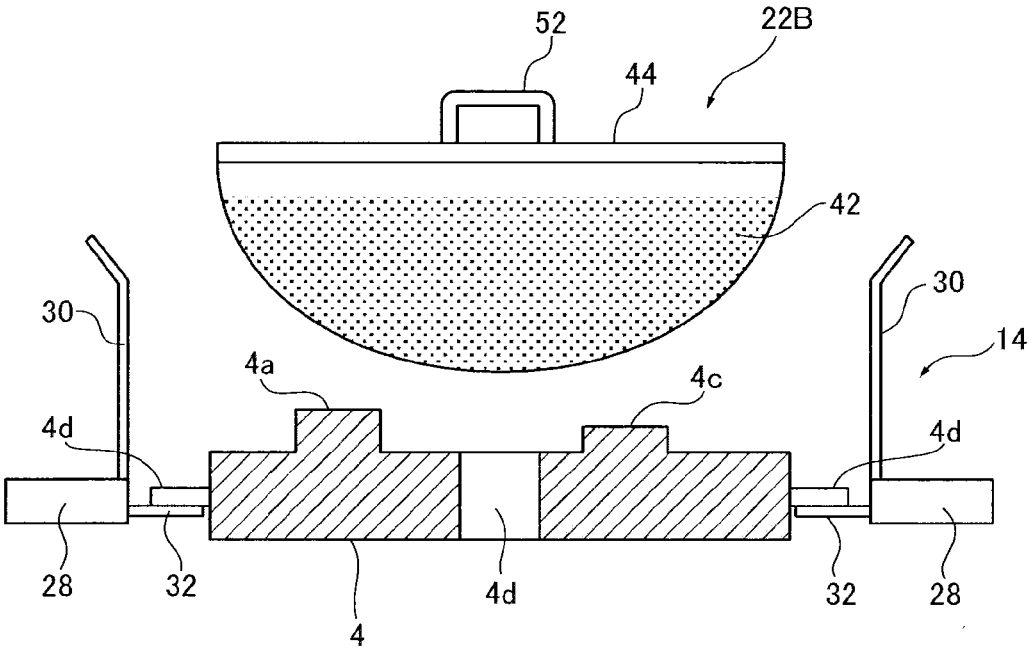
FIG. 5A shows an anti-cleanser dispersing element according to a second embodiment before inserted into the object holder and FIG. 5B shows the same when deformed by its own weight.
Figure 5B:
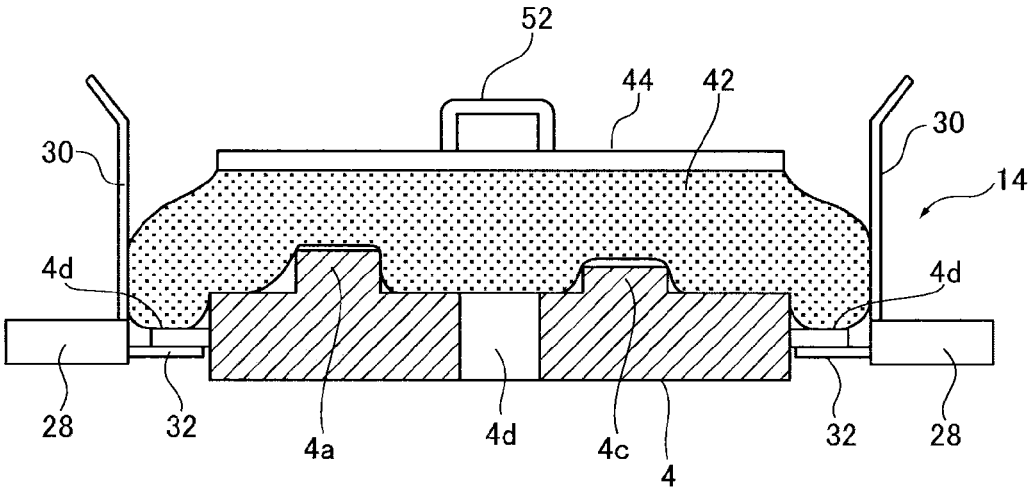

FIGS. 5A, 5B show an anti-cleanser dispersing element 22B according to a second embodiment. Only differences from the element 22A in the first embodiment are described. In the second embodiment the anti-cleanser dispersing element 22B is deformed by use of the weight of the core element 42 instead of the pressing of the pressure elements 24. The core element 42 according to the second embodiment is a soft bag such as a plastic bag containing granular elements such as beads. The plate 44 is provided with a handle 52 to allow an operator to hold up the anti-cleanser dispersing element and pull it down in the frame 14. The anti-cleanser dispersing element 22B is deformed by its own weight on the flow palette 4 as shown in FIG. 5B and can prevent the cleanser from dispersing effectively as the element 22A in FIG. 3B.

The anti-cleanser dispersing element 22B does not need the pressure elements, which eliminates the necessity for the operator to operate (lock or unlock) the pressure elements. It may be troublesome to handle the element 22B containing the beads but elevating and lowering the element 22*b* can be automated with a crane mechanism provided in the washing device. Alternatively, to omit the pressure elements 24, the plate 44 can be omitted or decreased in size and a horizontal protrusion is provided around the inner surfaces of the walls 30 to narrow the size of the opening of the frame 14. Then, the anti-cleanser dispersing element as a low repulsive urethane sponge is manually pressed into the frame and deformed. The protrusion functions to stop the element from restoring the original shape and maintain the deformation thereof.

Third Embodiment

A third embodiment is described with reference to FIGS. 6A to 6C. FIG. 7. The features of the present embodiment are in the frame 14 including an area adjuster 54 to adjust the size of an area of the frame 14 in which the object 4 is supported in accordance with the size of the object 4. As described above, the outer shapes (even or uneven) and horizontal and vertical sizes of the object 4 are various. In view of dealing with objects of various sizes, the area adjuster 54 is provided on one side of the base 28. The area adjuster 54 includes an adjustment shaft 56 to insert into the one side of the base 28 and slidable horizontally in the drawings, a movable plate 58 provided at an end of the adjustment shaft 56, and pins 32 fixed on the surface of the movable plate 58.

Figure 6A:
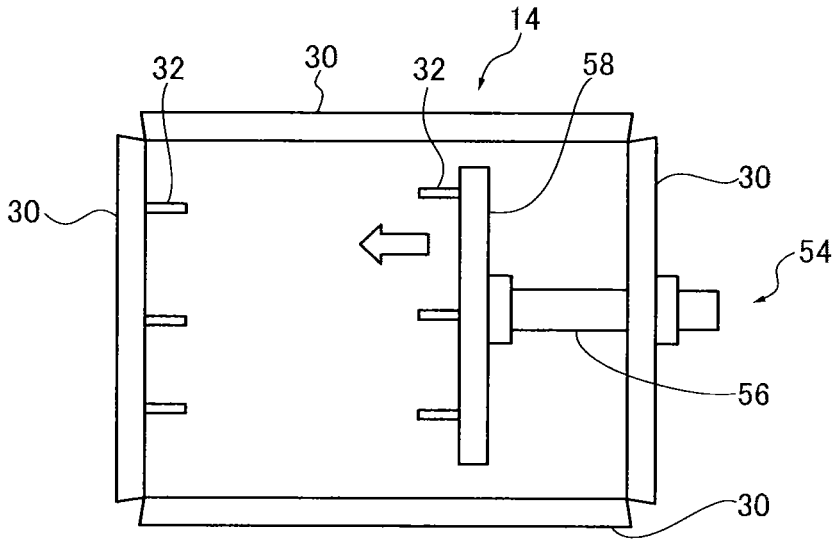
FIG. 6A is a plan view of the structure of an area adjuster.
Figure 6B:
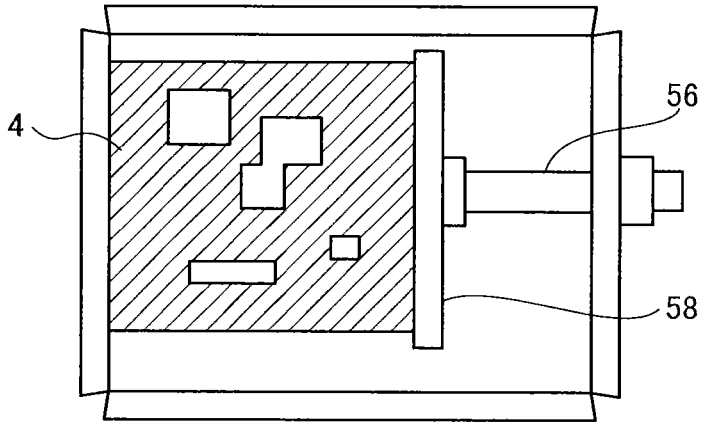
FIG. 6B shows an object holder on which an object is mounted after adjusting the area.

For cleaning a smaller object 4 than the opening size (maximum support area) of the frame 14, the movable plate 58 is moved in parallel by the manipulation of the adjustment shaft 56 to narrow the support area in accordance with the size of the object 4, as shown in FIG. 6A. Thus, flow palettes smaller than the frame can be properly secured in the frame 14. FIG. 6B shows the object 4 placed on the pins 32 after adjustment. The size of the anti-cleanser dispersing element 22 is unchanged to cover the maximum support area in FIG. 6C, even if a very small object 4 is subjected to cleaning.

Figure 6C:
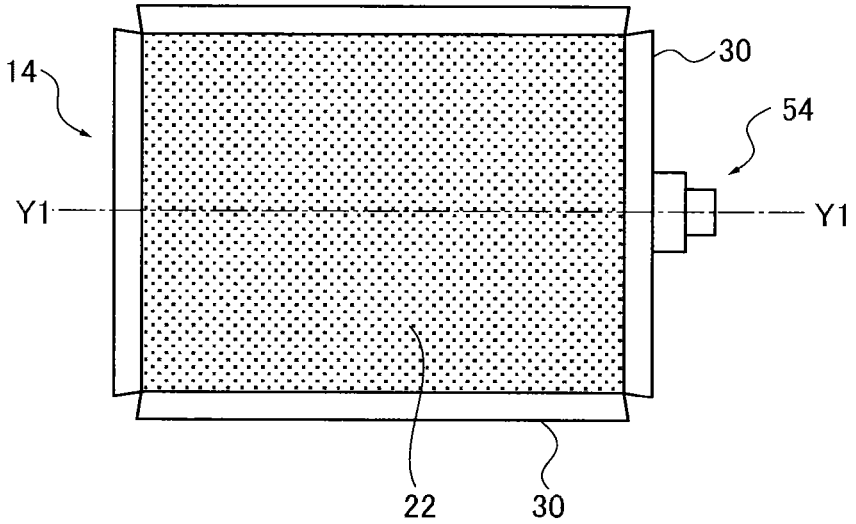
FIG. 6C shows the holder in which the anti-cleanser dispersing element is set.
Figure 7:
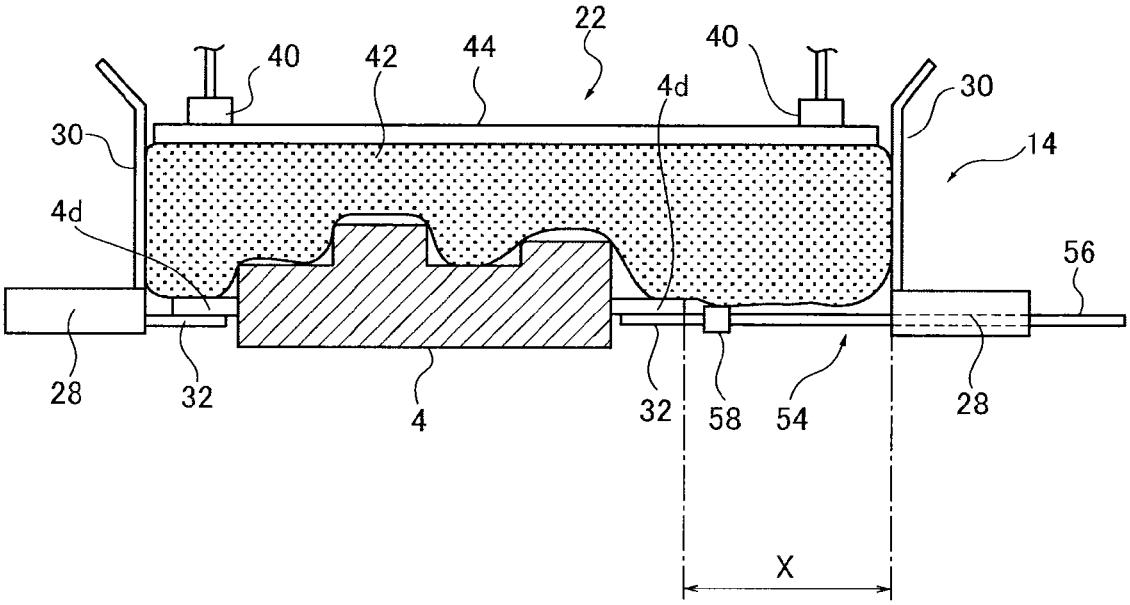
FIG. 7 is a cross section of the object holder along Y1 to Y1 line in FIG. 6C.

FIG. 7 shows the cross section of the frame 14 in FIG. 6C along Y1 to Y1 line. The size of the anti-cleanser dispersing element 22 corresponds with the maximum support area irrespective of a change in the size of the support area. When pressed by the pressure elements 24, the anti-cleanser dispersing element is arbitrarily deformed to close a space X in which no object is present, so as to prevent the cleanser 5 from being dispersed upward and reducing in the amount.

Figure 8:
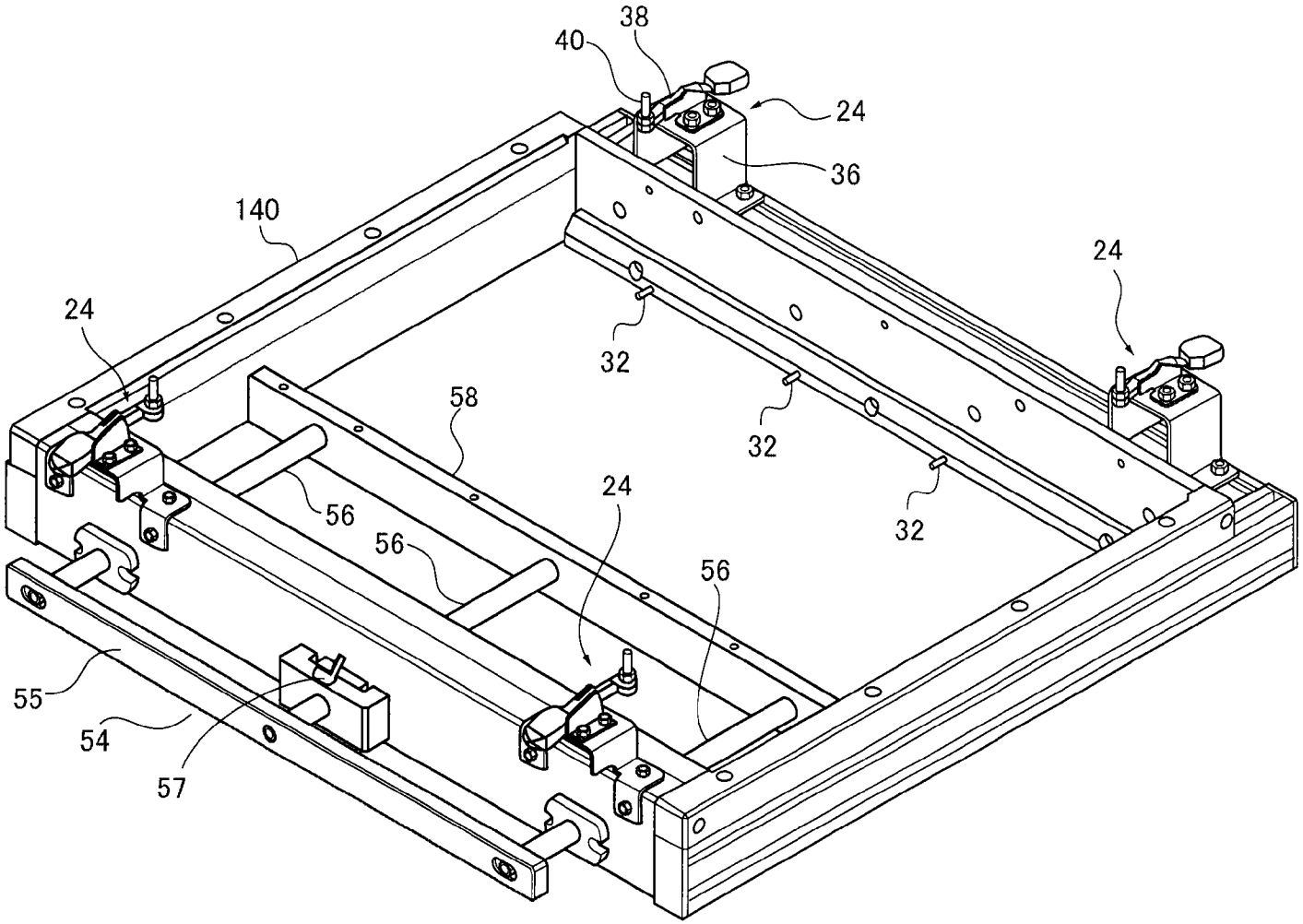
FIG. 8 is a perspective view of another example of the object holder.

Depending on the size of the object 4, a space is created in the lower part of the support area but it can be similarly closed by the deformed anti-cleanser dispersing element 22. Alternatively, a frame 140 can be configured of the base 28 also functioning as the walls 30 and the area adjuster 54 can include plural adjustment shafts 56 (three in the drawing) for stable adjustment, as shown in FIG. 8. The adjustment shafts 56 are connected via a connection plate 55 outside the frame 140. Although not shown, the pins 32 are provided on the bottom of the front surface of the movable plate 58. The position of the adjusted support area is fixed by fixing the center adjustment shaft 54 with a screw 57.

Fourth Embodiment

Figure 9B:
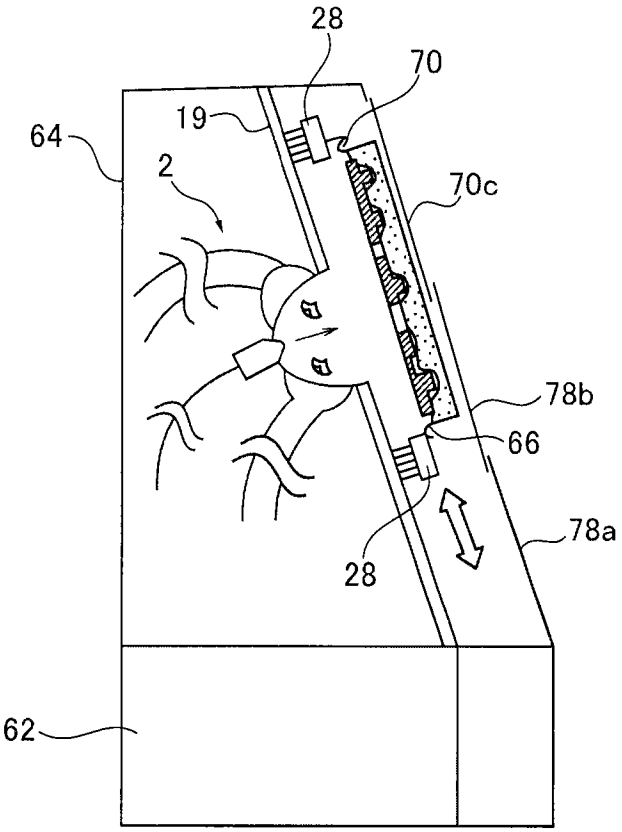
FIG. 9B shows the same in which the dispersing unit and a shutter are closed to be ready for washing.
Figure 9A:
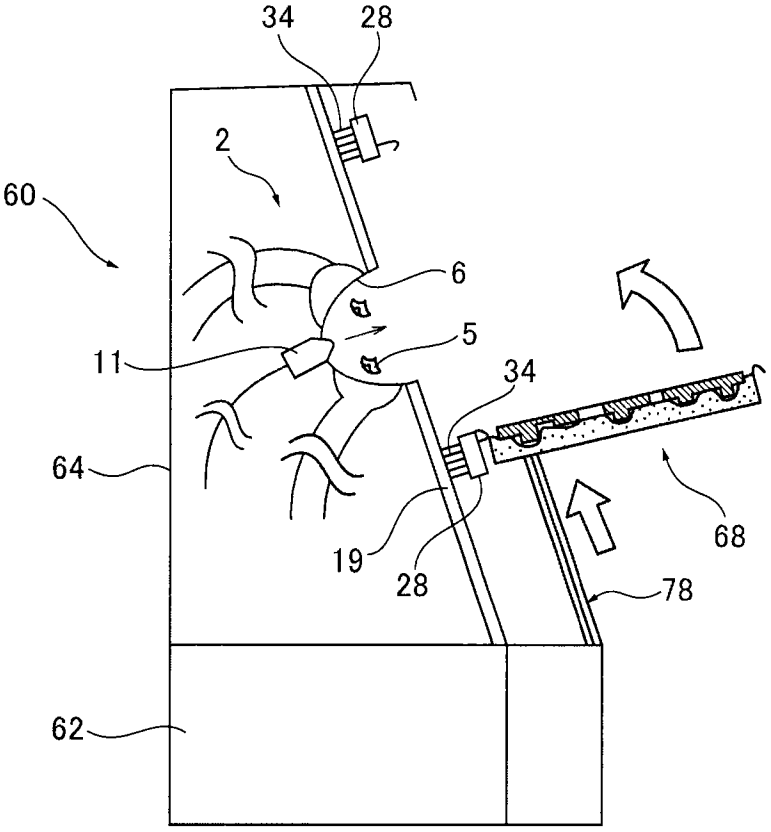
FIG. 9A shows a dry washing device according to a fourth embodiment in which an anti-cleanser dispersing unit is opened.

A fourth embodiment is described referring to FIGS. 9A, 9B and FIGS. 10A, 10B. In the fourth embodiment the anti-cleanser dispersing element is integrated with the object holder instead of separated as in the above embodiments, for the purpose of more reliably preventing the cleanser from leaking and easily securing the object. FIGS. 9A, 9B show an upright type dry washing device 60 comprised of a base 62 and a body 64 standing vertically on the base 62. The plane of the pool 19 is inclined rightward in the drawings relative to verticality. The tank unit 2 is disposed at the center of the pool 19 in the body 64, as in the first embodiment. The base 28 of the object holder is placed to face the opening of the tank unit 2 and connect with a not-shown direct driving means.

Figure 10A:
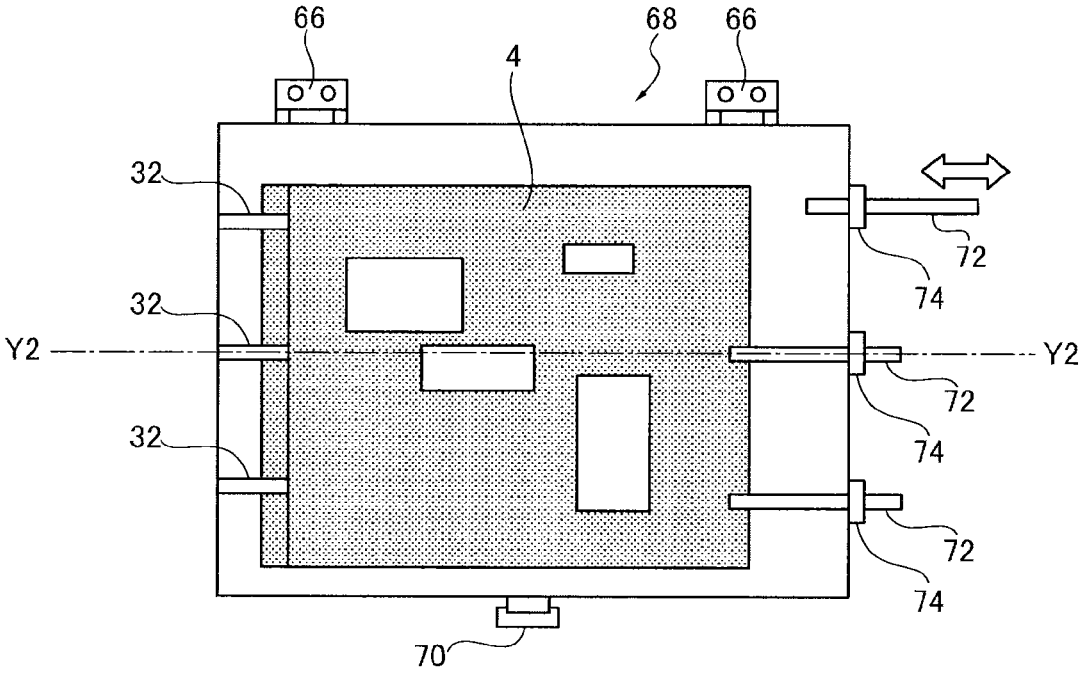
FIG. 10A is a plan view of the anti-cleanser dispersing unit in which an object is held and FIG. 10B is a cross section view of the same along Y2 to Y2 line in FIG. 10A.
Figure 10B:
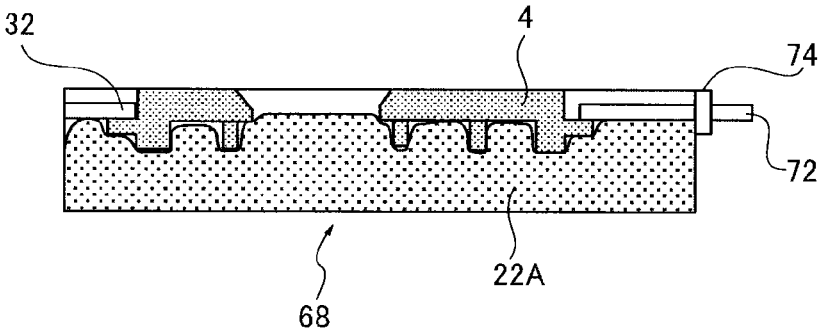

An anti-cleanser dispersing unit 68 is the anti-cleanser dispersing element integrated with the frame. It is connected with one side of the base 28 via a hinge 66. A lock mechanism 70 is disposed on the opposite side of the base 28 to securely connect the base 28 and the anti-cleanser dispersing unit 68. Referring to FIGS. 10A, 10B, length-adjustable pins 72 are placed on the side face of the anti-cleanser dispersing unit 68, and include pin fixtures 74 to lock the pins 72 along the anti-cleanser dispersing element 22A of the unit 68.

The anti-cleanser dispersing unit is moved in a closed space with a shutter 78 and an outer element for safety reason. The shutter 78 is made of three slidable plates 78*a*, 78*b*, 78*c*. With the shutter 78 opened, the opened anti-cleanser dispersing unit 68 can be supported by the hinge 66 as a fulcrum as shown in FIG. 9A.

Next, the operation of the dry washing device 60 is described.

First, an operator opens the shutter 78 and releases the lock mechanism 70 of the anti-cleanser dispersing unit 68 to pull down the anti-cleanser dispersing unit 68. Then, the anti-cleanser dispersing unit 68 is held by the hinge 66 and the opened shutter 78. The anti-cleanser dispersing element 22A is placed with the stretch material covering the low repulsive urethane sponge on the top side. The operator places an object 4 in the anti-cleanser dispersing unit so that the surface to be washed comes on the top side. Then, by adjusting the length of the pins 72, the operator inserts one end of the object 4 below the pins 32, manually holds it down and pushes it into the anti-cleanser dispersing element 22A as shown in FIGS. 10A, 10B. The operator extends the other pins 72 and fixes the positions thereof with the pin fixtures 74.

Thus, the object 4 is held while pressed onto the anti-cleanser dispersing element 22A. The pins 32 are adjusted so that the object 4 comes below the outer frame of the anti-cleanser dispersing unit 68. Then, the entire unit 68 is rotated around the hinge as the fulcrum to connect with the base and be fixed with the lock mechanisms. When the device is operated with the shutter 78 closed as shown in FIG. 9B, the cleanser is accelerated by compressed air to collide with the object and remove attached matter. The anti-cleanser dispersing unit 68 can prevent the cleanser from leaking to outside the washing tank 6 and the pool 19. By use of the anti-cleanser dispersing element 22A integrated with the frame, it is possible to improve the cleanser leakage preventing function from that in the above embodiments and reduce the time and labor of the operator.

Fifth Embodiment

A fifth element is described with reference to FIGS. 11, 12, 13A, 13B. The features of the present embodiment are in that plural objects are continuously washed, which is extremely difficult with the related art dry washing device since it needs to individually hold objects in the object holder. In the present embodiment a sponge roller is used for an anti-cleanser dispersing element 22C. It includes a low repulsive urethane sponge roller 80 as a core element and a stretch material 82 as a surface layer to cover the sponge roller 80. Hereinafter, the urethane sponge roller 80 covered with the stretch material 82 is called sponge roller 80. Further, a tank unit 84 is a drum type in which the cleanser is blasted off by revolving air flows generated from air intake and suction. The sponge roller 80 has a radius sufficient to close an opening 86 of the tank unit 84 with no object present.

The use of a flow palette for the object is described.

The sponge roller 80 is rotated to press the surface of a flow palette to close the openings thereof. A loader and unloader 88 to carry palettes 4 are provided before and after the tank unit 84 and sponge roller 80. The palettes are always held by either of the loader and unloader and moved in parallel. The sponge roller 80 is supported by a rotational shaft 81 and rotated by the movement of the palette 4.

Figure 11:
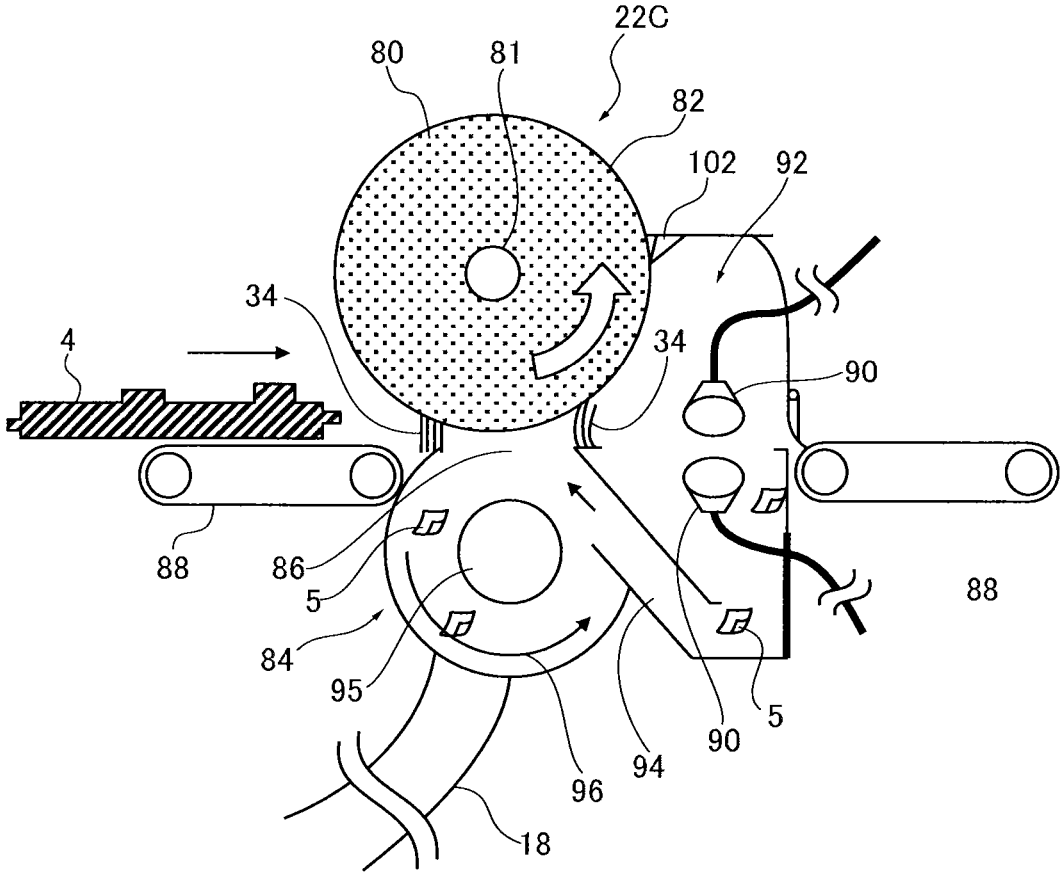
FIG. 11 is a schematic front view of a dry washing device according to a fifth embodiment.
Figure 12:
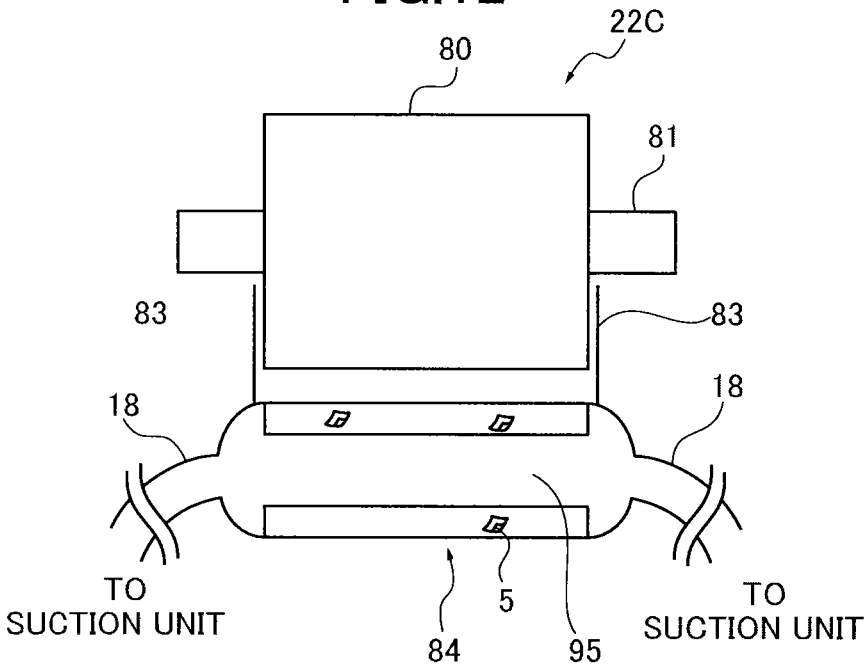
FIG. 12 is a schematic side view of the dry washing device in FIG. 11.

A space 92 is provided at downstream of the tank unit 84, in which the cleanser remaining on the sponge roller 80 and the palette 4 is blown off by an air nozzle 90 connected with the not-shown compressed air supply unit. The removed cleanser falls around an air inlet 94 of the tank unit 84 via a duct, and is suctioned into the air inlet 94 and blasted off again by the revolving air flows 96. FIG. 11 shows an air path limiting element 95 to define the cross sectional shape of the air streams 96 and also to function as a porous separator not to allow the cleanser to pass. While the opening 86 of the tank unit 84 is not closed with the palette, the amount of air inflow from the air inlet 94 is small and the cleanser 5 is absorbed onto the air path limiting element 95 by the air intake from the suction duct 18. With such a configuration, the amount of the cleanser in the tank unit can be prevented from decreasing by bringing back the cleanser attached to the object from the space 92. In FIG. 12 a reference numeral 83 represents side-walls to prevent the leakage of the cleanser.

Figure 13B:
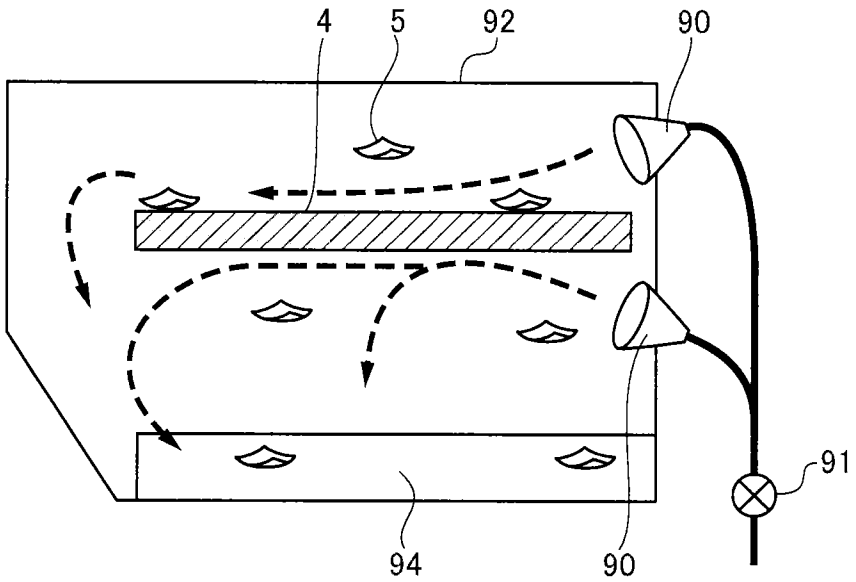
FIG. 13B is a cross section view of the same along Y3 to Y3 line in FIG. 13A when the cleanser is blown off.
Figure 13A:
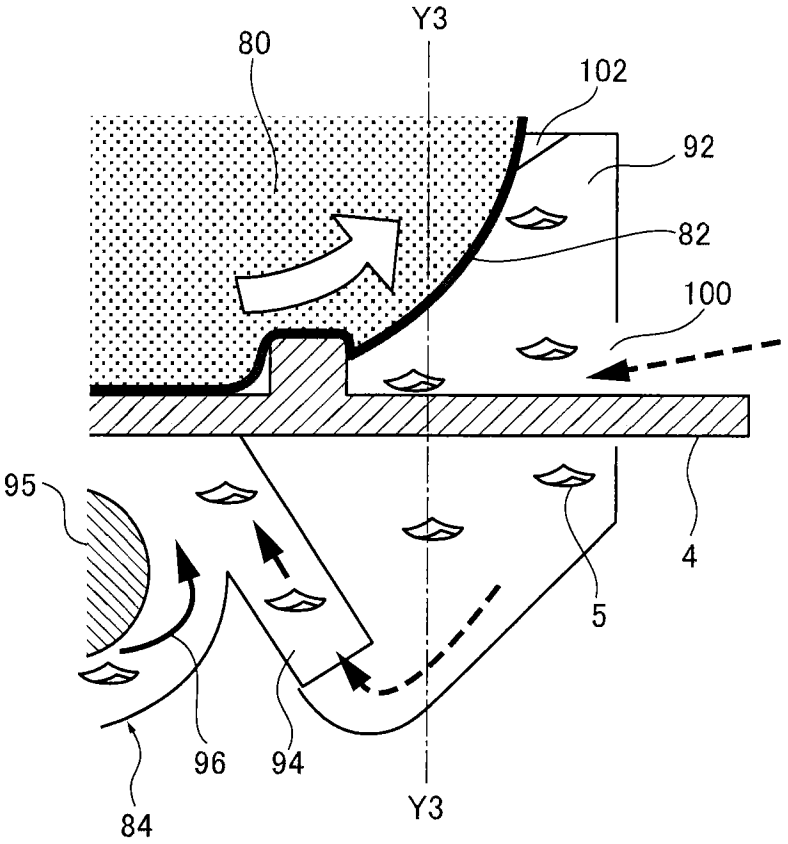
FIG. 13A is a schematic front view of the dry washing device in use when the object is discharged.

FIG. 13A, 13B shows an example of the space in which the cleanser is dispersed. As shown in FIG. 13B, the horn-shape air nozzles 90 blow compressed air from the side of the palette 4 in a large area of the space 92 to concurrently blow off the cleanser attached to the top and bottom surfaces of the palette 4 in a certain direction. The blow amount from the air nozzles 90 is adjusted by an air valve 91. Blown off from the top surface of the palette 4, the cleanser drops on the bottom of the space 92 through a space on one side of the space 92. The space 92 communicates with the air inlet 94 and suctioning air streams flow to the air inlet 94. The dropped cleanser is carried with the suctioning air streams, suctioned into the air inlet 94, and returned to the tank unit.

The suctioning air streams are supplied from an exit 100 of the space 92. At the exit 100 the air streams always flow towards the space 92. Because of this, the air streams from the nozzles 90 and the cleanser do not leak to outside the tank unit. Additionally provided with a short-curtain like element at the exit 100, it is possible to further prevent the leakage of the cleanser. Further, a scraper 102 can be provided to scrape off the cleanser attached to the surface of the sponge roller 80 due to static electricity and drop it in the space 92 and collect it in the tank unit. Thus, the dry washing device which can wash plate-like objects continuously is realized.

A dry washing device according to a sixth embodiment is described with reference to 14A to 14C. A dry washing device 110 or palette washing device comprises a washing unit 112 with an opening to blow off the cleanser by revolving air flows, have it collide with an object from the opening in a part of the revolving area and clean the object, an object holder 114 to hold the object in a washable position, and a three-axis type orthogonal robot 116 to move the washing unit 112 to different positions. The orthogonal robot 116 comprises an X shaft 118 for horizontal movement indicated by the arrow D1, a Y shaft 120 for orthogonal movement relative to the drawings, and a Z axis shaft 122 for vertical movement, a base to support these shafts, and a not-shown controller to control the movement of the shafts. The washing unit 112 is attached to the bottom end of the Z shaft 122 via a spring 123. The object holder 114 includes a support frame 124 for the anti-cleanser dispersing element 22, a pair of frames 126, 128 extending upward from the support frame 124, and the anti-cleanser dispersing element 22 accommodated in the frames 126, 128. The support frame 124 also works as the base of the orthogonal robot 116.

Pins 32 are fixed to the frame 128 to inhibit the palette from floating up by the repulsive force of the anti-cleanser dispersing element 22. Longer pins 32 are provided on the other frame 126 to be able to hold palettes of different sizes movably in the direction indicated by the arrow H (in FIG. 14C). In the present embodiment the anti-cleanser dispersing element 22 is configured to cover the object 4 from below while in the above embodiments it covers the object 4 from above.

The washing unit 112 is connected with a suction hose 130 which is connected with a not-shown suction unit. The washing unit 112 is configured to generate revolving air flows at a high speed inside to circulate the cleanser, and allow the cleanser to collide with the object 4 and wash it in an opening 112*a* in the revolving area. When the opening 112*a* is closed with the object 4 while the washing unit 112 is being air-suctioned by the suction unit, outside air is flowed thereinto at a high speed from an inlet 112*b*, producing revolving air flows around a cylindrical element 112*c* at the center of the unit 112 as a rotational axis. Thereby, the cleanser is dispersed in the housing of the washing unit 112.

A not-shown porous element is provided between the connecting portion with the suction unit and the inside of the housing. The holes of this element are of a size enough to allow matters to be removed to pass therethrough but to prevent the cleanser from passing therethrough. When the inside of the housing is negatively pressurized by suction, the cleanser is absorbed onto the porous element until the revolving air flows are produced. Therefore, the cleanser is held inside the housing and does not leak to outside even with the opening 112*a* separated from the object 4. The washing unit 112 uses a housing disclosed in Japanese Patent Application Publication No. 2012-050973 filed by the applicant of the present invention. The washing unit 112 is enclosed in a rectangular case and a spring 123 is fixed to the case, thereby facilitating the connection of the Z shaft 122 and the unit 112 via the spring 123.

A seal element 132 with a smooth surface made from a flexible material is provided around the opening 112*a* of the washing unit 112. This helps the opening 112*a* closely attach to the palette 4 in accordance with the unevenness in the surface thereof. The seal element 132 can be a brush with nylon hairs or a sponge covered with a felt material.

The operation of the dry washing device 110 is described.

First, an operator provides a proper amount of cleanser in the housing of the washing unit 112 by suctioning it from the opening 112*a* or pouring it from the air inlet 112*b*. Next, the operator sets the palette 4 on the anti-cleanser dispersing element 22, and inserts one end of the palette 4 below the fixed pins 32 and pushes the other end to hold it down by manipulating the movable pins 32. Once the palette 4 is secured, the operator makes sure that all the openings of the palette are enclosed with the anti-cleanser dispersing element 22 and inputs an operation start signal to the not-shown controller to operate the suction unit. The controller then operates the X and Y shafts of the orthogonal robot 116 to move the washing unit 112 to the corner (washing home position) of the palette 4.

Then, the controller operates the Z axis of the orthogonal robot 116 to lower the washing unit 112 and press it down onto the palette until the spring 123 is deflected at a certain amount. By this pressure, the seal element 132 is deformed to closely attach to the palette and close the opening 112*a* of the washing unit 112, thereby decreasing the pressure in the washing unit 112 by suction and increasing the amount of air streams flowing thereinto from the air inlet 112*b*. Thus, the cleanser is dispersed by revolving air flows in the washing unit 112 and collides with the palette 4 closely attaching to the opening 112*a*. Thereby, the fluxes on the palette surfaces can be quickly removed.

Figure 14B:
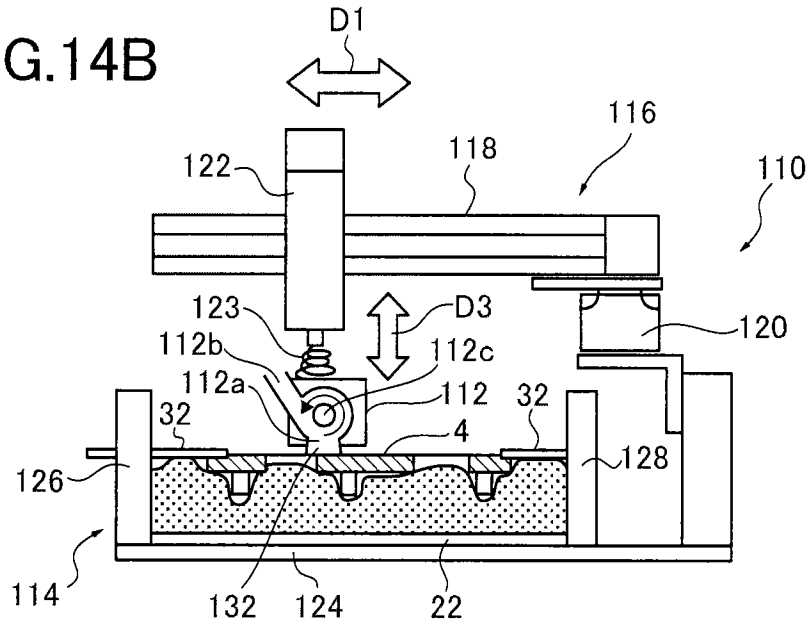
FIG. 14B is a front view of the same in washing operation.
Figure 14A:
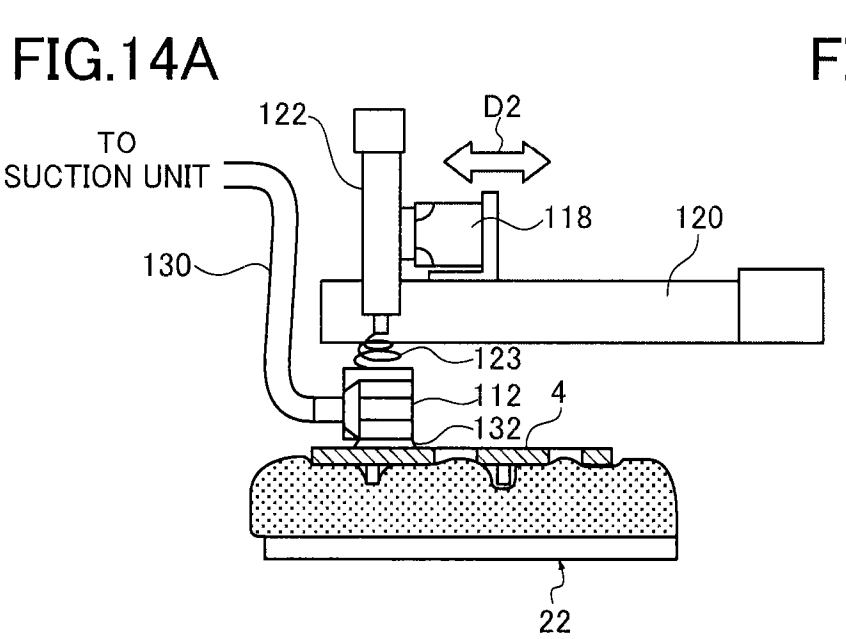
FIG. 14A is a side view of a dry washing device according to a sixth embodiment in washing operation without the object holder.
Figure 14C:
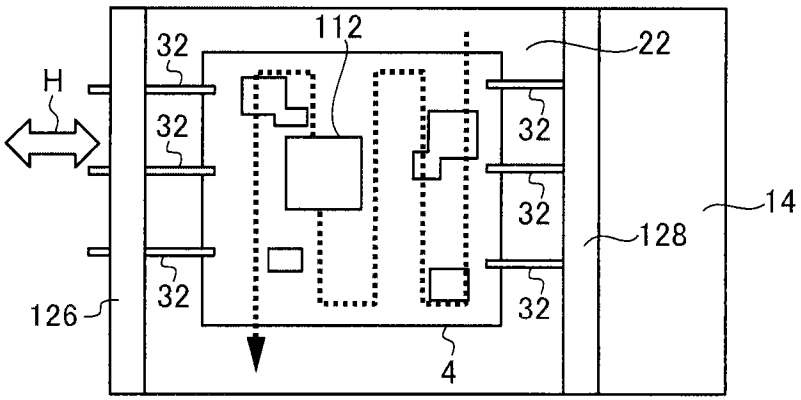
FIG. 14C is a plan view of a washing unit with a trajectory of a moving washing unit.
Figure 15:
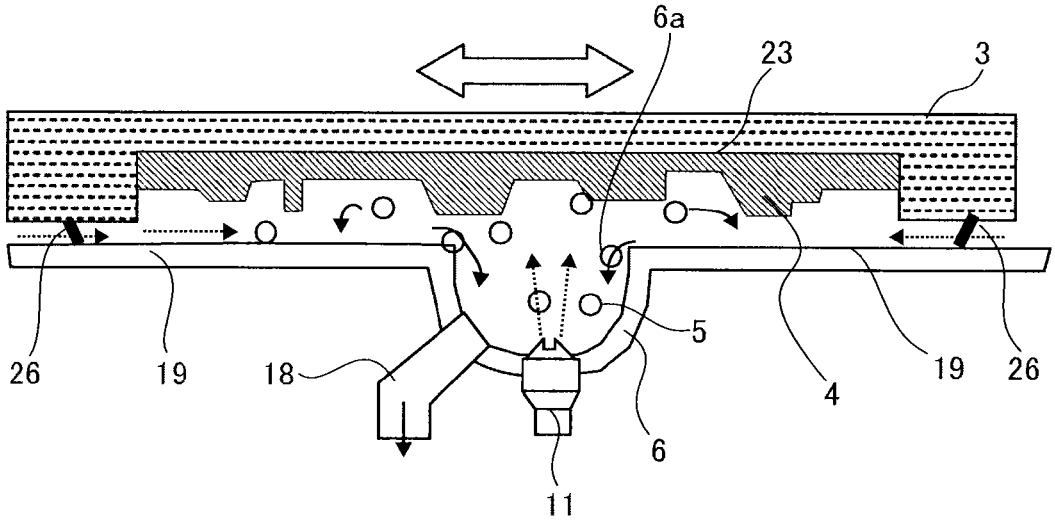
FIG.15 PRIOR ART
FIG. 15 is a cross section view of the essential part of a related art dry washing device.
Figure 16:
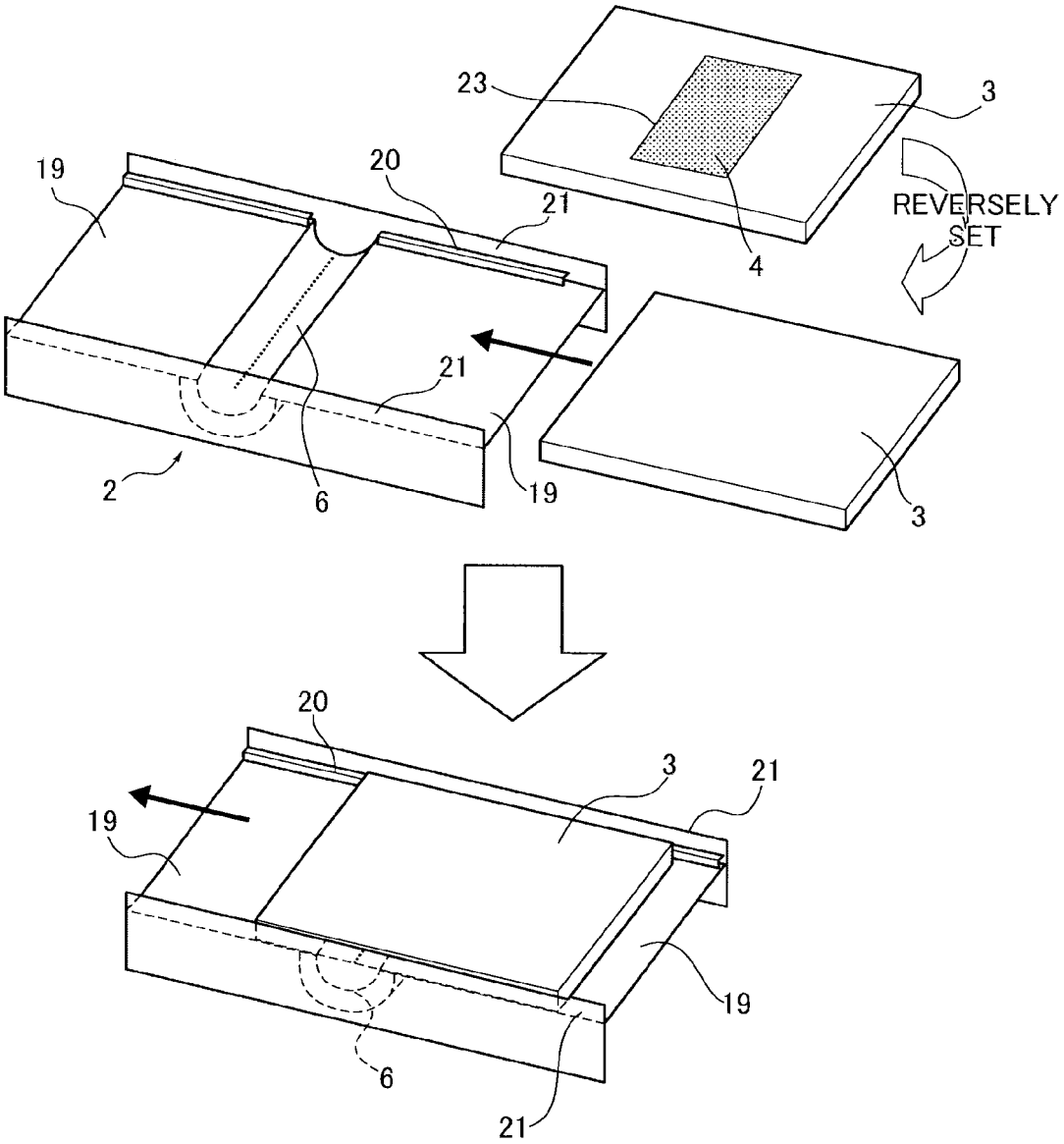
FIG.16 PRIOR ART
FIG. 16 perceptively shows how to set an object in the dry washing device in FIG. 15.

Next, the controller moves in parallel the washing unit 112 contacting the palette 4 as indicated by the broken line in FIG. 14C. It can move it in parallel by the spring 123 along the Z shaft while pressing down the palette irrespective of the unevenness or undulation in the palette surface. By the parallel movement, the washing unit 112 can wash the area larger than the opening 112*a*. Moreover, the deformation of the anti-cleanser dispersing element 22 can prevent the occurrence of a gap at the end of the palette or around the opening so that the entire palette surface can be washed without the leakage of the cleanser from the opening of the washing unit. The movement of the washing unit 112 is programmed in advance. Alternatively, the washing unit can be discontinuously moved since the cleanser does not leak to outside due to the cleanser dispersion and absorption effect even if the washing unit is separated from the object (disclosed in Japanese Patent Application Publication No. 2012-50973).

It is preferable to move the washing unit in line with the shape of the palette if the palette is made of a frame only or a different-shape palette is used. By optimally moving the washing unit, the washing can be completed in a shorter time and the consumption of cleanser can be reduced.

In the present embodiment the orthogonal robot is used for the moving element for the washing unit. Alternatively, a horizontal or vertical multi-joint robot can be used.

Further, in the present embodiment the palette is disposed with the surface to be washed on the top side. However, the surface to be washed can face sideways or downward as long as the opening of the palette as an object can be closed with the anti-cleanser dispersing element. It can be washed by changing the movement of the washing unit.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A dry washing device which disperses cleanser by an air stream to allow the cleanser to collide with an object for washing, comprising:

an object holder including:

a frame to hold the object; and an anti-cleanser dispersing element including a rigid plate and a core element, and a washer with an opening from which the cleanser is dispersed, wherein the core element is configured to be deformed by its own weight or pressure in accordance with an uneven outer shape of the object, to tightly attach to the object with no gap between the frame and the core element, wherein the object holder holds the object in a washable position between the anti-cleanser dispersing element and the opening of the washer.

2. The dry washing device according to claim 1, further comprising a surface layer to cover a surface of the core element, made from an anti-wear material to protect from the collision of the cleanser and not to inhibit a deformation of the core element.

3. The dry washing device according to claim 2, wherein the core element is made from a low repulsive foaming material.

4. The dry washing device according to claim 2, wherein the surface layer is replaceable.

5. The dry washing device according to claim 1, wherein the frame includes a pressing element to deform the anti-cleanser dispersing element by pressure.

6. The dry washing device according to claim 1, wherein the frame is configured to maintain a deformed state of the anti-cleanser dispersing element.

7. The dry washing device according to claim 1, further comprising:

an area adjuster to adjust an area of the frame in which the object is held, in accordance with a size of the object.

8. The dry washing device according to claim 1 wherein the cleanser is dispersed by a revolving air flow, the opening from which the cleanser is introduced to collide with the object s in a part of a revolving area; and the dry washing device further comprises a mover to move the washer to change the washing position.

9. The dry washing device according to claim 1, wherein the object includes an opening, and the anti-cleanser dispersing element is configured to be deformed in accordance with the uneven outer shape of the object to enclose the opening and a gap between the object and the holder.

10. The dry washing device according to claim 9, wherein the object includes a through hole, and the anti-cleaner dispersing element allows only one side of the through-hole to be enclosed.

11. A dry washing device which disperses cleanser by an air stream to allow the cleanser to collide with an object for washing, comprising:

an object holder including:

a frame to hold the object; and an anti-cleanser dispersing element, and a washer with an opening from which the cleanser is dispersed, wherein the anti-cleanser dispersing element is configured to be deformed by its own weight or pressure in accordance with an outer shape of the object, to tightly attach to the object with no gap between the frame and the anti-cleaner dispersing element; and wherein the object holder holds the object in a washable position between the anti-cleanser dispersing element and the opening of the washer.

* * * * *